United States Patent [19]

Maier et al.

[11] 4,180,051

[45] Dec. 25, 1979

[54] FURNACE

[75] Inventors: Michael W. Maier, Beaver Dam; James J. Polzin, Juneau, both of Wis.

[73] Assignee: Malleable Iron Range Company, Beaver Dam, Wis.

[21] Appl. No.: 907,837

[22] Filed: May 19, 1978

[51] Int. Cl.[2] ..... F24C 1/14

[52] U.S. Cl. ..... 126/77; 126/63; 126/66; 126/67; 126/80; 126/146; 126/193; 236/96

[58] Field of Search ..... 126/66, 77, 61, 63, 126/67, 80, 146, 193, 289; 236/95, 96

[56] References Cited

U.S. PATENT DOCUMENTS

| | | | |
|---|---|---|---|
| 3,168,088 | 2/1965 | Martin et al. | 126/77 |
| 4,015,579 | 4/1977 | Wirth | 126/63 |

*Primary Examiner*—Samuel Scott
*Assistant Examiner*—Daniel J. O'Connor
*Attorney, Agent, or Firm*—Foster York; Claron N. White

[57] ABSTRACT

The furnace for burning wood or coal has a cabinet with a front wall and interconnected spaces between the inner and outer walls at the sides, top, bottom and rear. One of two outer walls have an inlet and outlet for flow of air to be heated. There are aligned flue openings in the upper portion of one of the sets of spaced walls. A grate and an ash pan below are mounted within a lower portion of the cabinet. The front wall has at least one opening closed in an airtight manner by one or two doors. A damper, having a pipe and plate pivotally mounted on the top of the pipe at its front end, is connected to a bimetallic thermostat above it. Both are mounted on the front of the furnace. The thermostat is mounted for movement to open the damper. The front wall of the cabinet or the door, when there is one door, separates the thermostat from the fire chamber within the cabinet above the grate. The furnace construction separates entirely, or almost entirely, the thermostat from any air being heated during flow through the interconnected spaces so that the thermal energy sensed by the thermostat is entirely or primarily radiant energy from the front wall of the cabinet or the door between the thermostat and the fire chamber.

6 Claims, 13 Drawing Figures

FURNACE

BRIEF SUMMARY OF THE INVENTION

The furnace of the present invention is constructed to burn wood or coal in an airtight fire chamber and to control more precisely the intake draft of air for burning or combustion of the fuel. The furnace of the invention includes a cabinet having a double wall construction for its sides, top, bottom and back to provide passageways for air to be heated. A grate is mounted in a lower portion of the cabinet and an ash pan is slidably mounted below the grate. The interior of the cabinet above the grate constitutes a fire chamber. The front of the cabinet has one or two openings. When there is one opening it provides access to the fire chamber for loading it with fuel and to the lower portion of the cabinet for removal of the ash pan. When there are two openings in the front of the cabinet there is separate access to the fire chamber and to the ash pan. The door for the one opening and two doors for the separate openings are mounted on the front wall of the cabinet and constructed to provide an airtight closing of the opening or openings.

The furnace further includes an assembly of a damper, a chain and a temperature sensing means, such as a bimetallic thermostat, mounted at the front of the furnace. The damper includes a short pipe and a damper plate pivotally mounted at its top on the front end of a pipe. The bottom portion of the damper plate is connected to the bottom end of the chain that has its top end connected to the temperature sensing means.

The construction of the temperature sensing means is conventional. It is such that it can be manually turned from a position, at which the chain connection allows the damper plate to close the damper, to a position at which the chain holds the damper plate partially raised for a particular opening of the damper to allow the proper rate of intake air for a desired temperature in the fire chamber. Until a temperature sensed by the temperature sensing means exceeds a temperature indicative of the desired temperature in the fire chamber the damper is unchanged. When the temperature that is sensed exceeds that indicative of the desired temperature in the fire chamber, the temperature sensing means operates to lower its connection to the chain and thereby lower the damper plate. If the temperature in the fire chamber becomes less than the desired temperature and thereby the temperature sensed by the temperature sensing means will be lower, it operates to raise the chain for an opening of the damper plate. By this construction there will be a slight movement of the damper plate under the control of the temperature sensing means to change the rate of intake of air and thereby to control the temperature in the fire chamber.

The front of the furnace is constructed so that the temperature sensing means is mounted either on the outside of a front wall of the cabinet or on the outside of a wall of the door where that separates it from the fire chamber so that the chamber sensing means will respond mainly, and in some embodiments of construction entirely, to the radiant energy from that separating wall that is heated by the combustion occurring in the fire chamber. This location of the assembly of damper and temperature sensing means at the front of the furnace differs from prior constructions that locate the assembly of damper and temperature sensing means within a vertical passageway provided by the double-walled construction of one of the sides or the rear of the cabinet where the temperature sensing means is responsive to the radiant energy from the inner wall of the side or rear of the cabinet, but main response is provided by the temperature of the air, being heated, as it passes upwardly through the vertical passageway. As a result of the location of the assembly of damper and heat sensing means at the front of the furnace of the invention, as described above, there is a reduced amplitude of variation of the temperature in the fire chamber and thus greater control operation of the furnace. It is believed that the improved control is due to sensing of radiant energy alone or, in a preferred modification of one embodiment of the furnace, along with only a small percentage of the air that has been heated by movement through the passageways of the double-walled construction of the cabinet.

Part of the ambient air that passes to and through the damper in the present furnace passes the temperature sensing means but the temperature of that air has an inconsequential effect on the temperature sensing means. The rate of flow is substantially less than the rate of flow of the air being heated in the passageway of the double-walled construction of a side or rear of the cabinet where the ambient air is heated by the furnace as it moves toward the temperature sensing means when it and the damper are located in such passageway as is the case for the constructions of the prior art.

In the furnace the hot combustion gases from the fire chamber pass out through an opening in a side wall or the top wall of the cabinet that is connected to a smoke pipe that is connected at one end to a chimney.

In one construction of the furnace of the invention the outer wall of one of the sides or back has an opening communicating with the outlet opening of an attached blower and in that construction the top of the cabinet has a double-walled construction with its inner wall defining the top wall of the fire chamber and its outer wall having an opening to which is connected ductwork for passage of the heated air to other parts of the building in which the furnace is located. In this case, the opening for the exiting of combustion gases is at the side of the cabinet.

The furnace of the invention can be used alone to heat a room or to heat a number of rooms of a building, such as a home. The furnace of this invention can be used in conjunction with a conventional furnace that burns oil or gas and that provides through ductwork the heating of a number of rooms of a building. The additional components connected to the furnace of the invention and to the chimney and ductwork including the cold air return ductwork communicating with the rooms and ductwork for heated air will be apparent from the description that follows.

DETAILED DESCRIPTION

In the following description similar components are usually identified by the same numeral.

Figures 1, 2, 3:
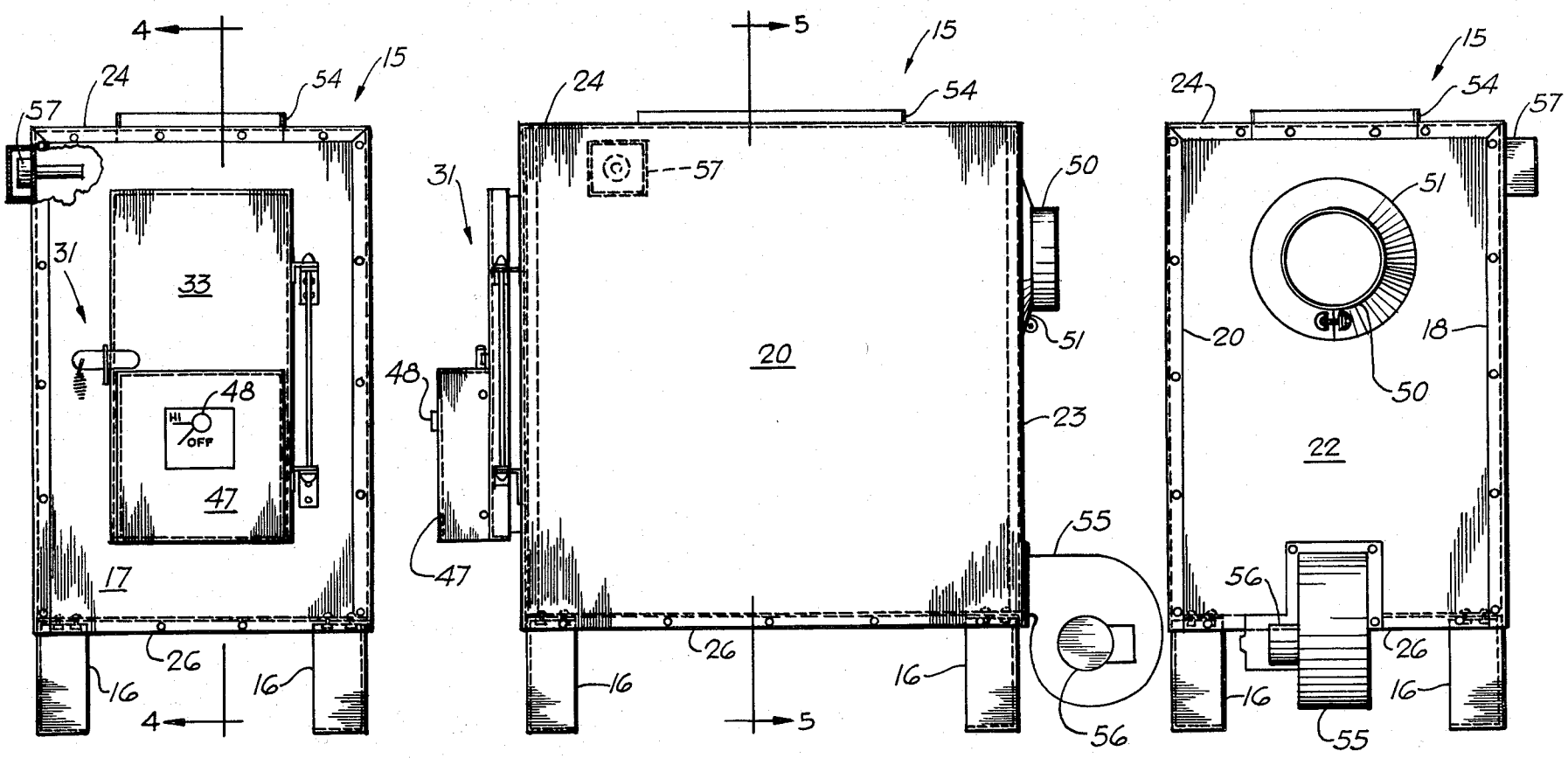
FIG. 1 is a front view of one preferred embodiment of the furnace of the invention.
FIGS. 2 and 3 are side and rear views of the furnace of FIG. 1.

Referring to FIGS. 1 through 3, this embodiment of the furnace of the invention includes a cabinet generally indicated at 15. The cabinet 15 is supported by legs 16 at its four corners. The cabinet 15 has a front wall 17. The construction of cabinet 15 is apparent from FIGS. 1 through 5. Because much of the construction of the cabinet and other components are not a part of the novel construction of the invention details relating to their fabrication need not be described.

Figure 4:
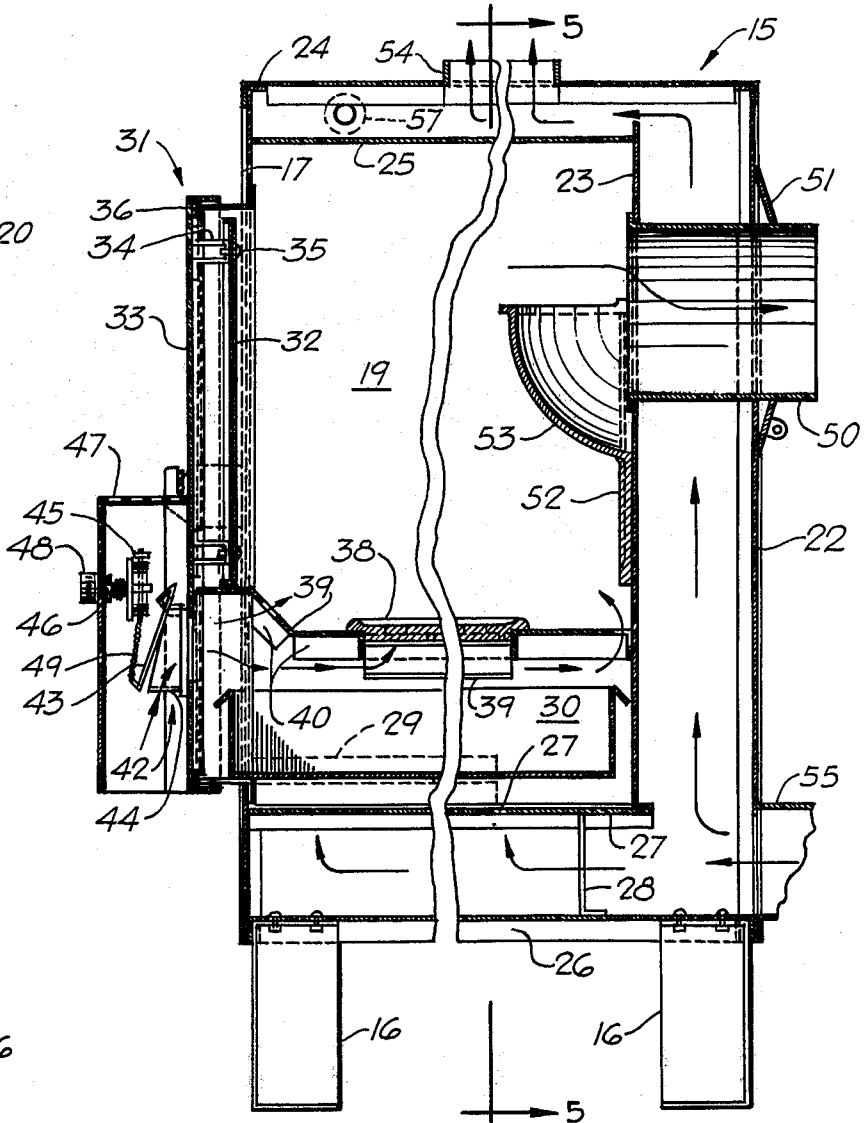
FIG. 4 is a vertical section taken along line 4—4 of FIG. 1 and a vertical section along line 4—4 of FIG. 5.
Figure 5:
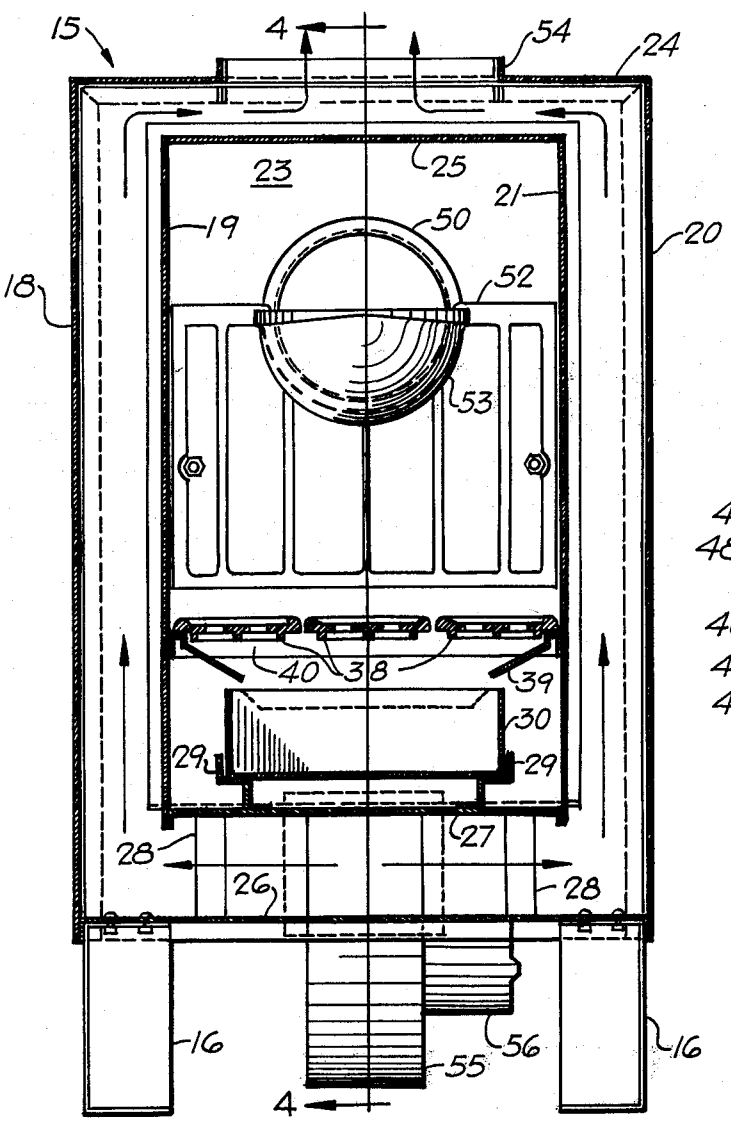
FIG. 5 is a vertical section taken along line 5—5 of FIG. 2 and a vertical section taken along line 5—5 of FIG. 4.
Figure 8:
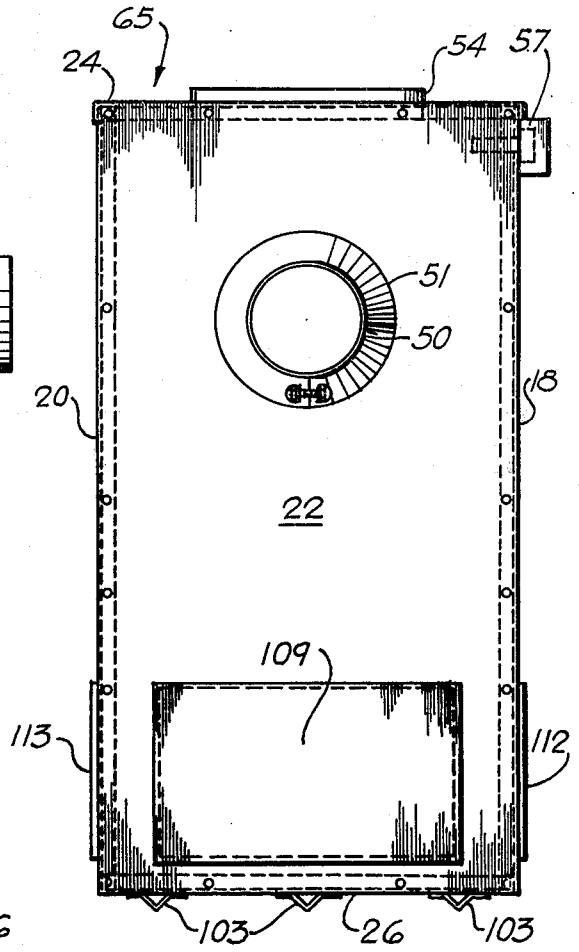
FIGS. 7 and 8 are front and rear views of the furnace shown in FIG. 6.
Figure 6:
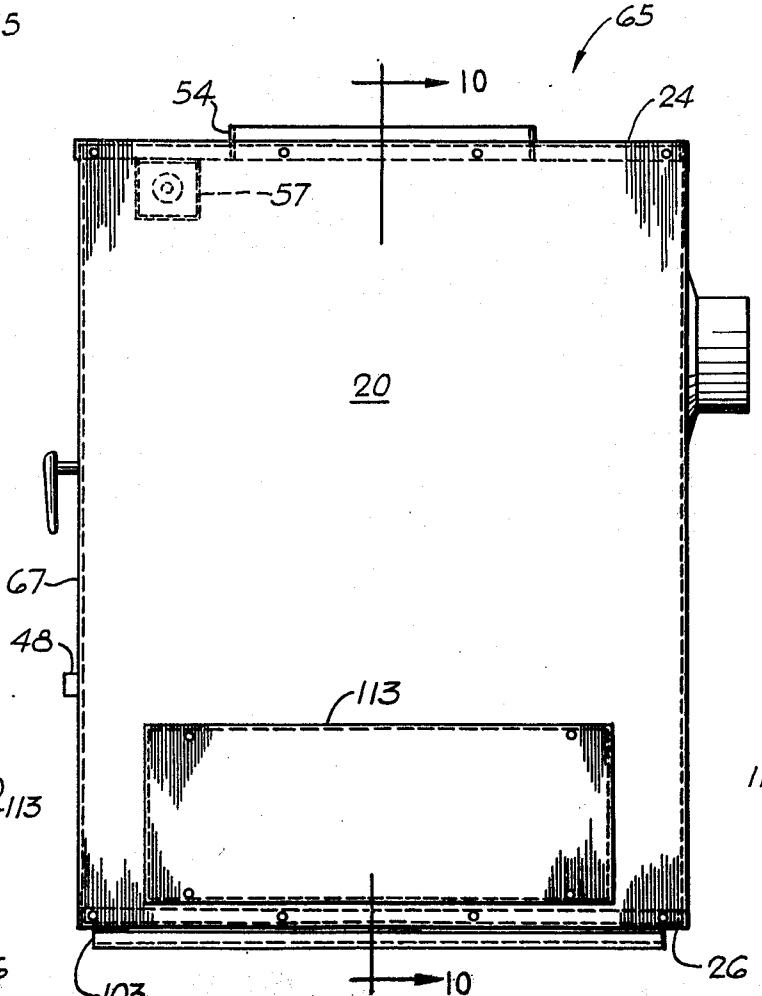
FIG. 6 is a side view of an especially preferred embodiment of the furnace of the invention.

As seen in FIG. 5, each of the sides and rear of cabinet 15 have a double-walled construction with each having two spaced walls to provide a passageway for air being heated. One side of cabinet 15 has an outer wall 18 and an inner wall 19. The other side of cabinet 15 has an outer wall 20 and an inner wall 21. As seen in FIG. 4, the rear of cabinet 15 has an outer wall 22 and an inner wall 23. The top and bottom of cabinet 15 also have a double-walled construction. The top has an outer wall 24 and an inner wall 25 and the bottom of cabinet 15 has an outer wall 26 and an inner wall 27.

The front ends of walls 24 through 27 are connected to front wall 17 as shown in FIG. 4. The outer walls 24 and 26 are connected to outer walls 18 and 20 as shown in FIG. 5. The rear of walls 24 and 26 are connected to outer rear wall 22 as shown in FIG. 4. The rear portion of inner wall 27 of the bottom of cabinet 15 is supported by and spaced from outer wall 26 by a spaced pair of angle irons 28 (FIGS. 4 and 5). The inner wall 23 is supported by inner walls 25 and 27 to which it is connected at their rear ends. By this construction there is provided a chamber within cabinet 15 that is defined by inner walls 19, 21, 23, 25 and 27 and front wall 17. There is also provided a rear vertical passageway between walls 22 and 23, a side vertical passageway between walls 18 and 19, a side vertical passageway between walls 20 and 21, a top horizontal passageway between walls 24 and 25 and a bottom horizontal passageway between walls 26 and 27 that communicate with one another and that are separated from and surround the chamber mentioned above.

The inner wall 27 supports a pair of spaced elongated Z-bars 29 that extend rearwardly and spaced from front wall 17. The bars 29 slidably support an ash pan 30 in the chamber mentioned above. The front and rear walls of pan 30 have downwardly turned flanges, with the rear flange serving, by abutment with wall 23, to properly position pan 30 in the chamber.

The front wall 17 has a central rectangular opening (not numbered) at which wall 17 has a forward flanged extension (FIG. 4) to provide a door frame. A door generally indicated at 31 is hingedly mounted on front wall 17 at this central opening and door 31 can be latched in closed position as seen in FIG. 1. The door 31 has an inner wall 32 and an outer wall 33 that are secured together by spacers 34 and screws 35 with the spacers being secured to wall 33. This construction is seen in FIG. 4.

The door 31 is mounted in alignment with the opening of front wall 17. The front wall 33 of door 31 has a rearwardly directed flange at its periphery. The dimension of wall 33 is such that, when the door is closed, the forward angular extension of front wall 17 at its opening abuts a gasket 36 secured on the inner face on outer wall 33 of door 31 adjacent its peripheral flange, so that there is an airtight seal, to close this opening of front wall 17 of cabinet 15, when door 31 is locked in the closed position.

The inner wall 32 of door 31 has a shorter height and width than that of outer wall 33, and wall 32 is located so that there is a space between its periphery and that of wall 33 and the top and sides of the frame of door 31 with the peripheral flange of wall 33 of door 31, at its top, sides and bottom being outside the door frame of front wall 17 and with wall 32 being inside the door frame. The bottom of inner wall 32 is spaced above the front end of pan 30.

A grate 38, constructed in the form of three grate components (FIG. 5), is supported by a grate support member 39 that is connected at its periphery to inner walls 19 and 20 of the sides of cabinet 15. For this support member 39 has downwardly turned flanges 40 at its two ends that are connected to side walls 19 and 20 and rear wall 23 (FIGS. 4 and 5). The support member 39 has a large opening that has smaller dimensions than grate 38 that rests on support member 39. The portion of support member 39 forward of grate 38 has an upward offset so that the marginal forward part is at a horizontal plane above grate 38 and the part between that marginal part and the part adjacent the opening of support member 39 is upwardly inclined. This construction serves to prevent the forward sliding movement of the load of fuel on grate 38. The bottom of inner wall 32 of door 31 is above this horizontal marginal part of the offset portion of support member 40.

A damper generally indicated at 42 is mounted on outer wall 33 of door 31 in alignment with and extending into an opening in wall 33. The damper 42 includes a damper plate 43 and a damper intake pipe 44. The plate 43 is pivotally supported at its top end by the top portion of the forward end of pipe 44.

A thermostat 45, that has a conventional bimetallic construction, is rotatably mounted on a bracket (not shown) that is mounted on door 31 so that the thermostat is above the horizontal plane passing through the top of grate 38. Rod 46 of thermostat 45 extends forwardly through the front wall of a cover 47 that is also mounted on outer wall 33 of door 31. A knob 48 to rotate thermostat 45 is secured on rod 46 outwardly of the front wall of cover 47. The bottom of cover 47 is open and there are holes in the top wall of cover 47.

The bottom end of a chain 49 is connected to the bottom end of damper plate 43. The top end of chain 49 is connected to the free end of the bimetallic element of thermostat 45. Indicia on the front plate of cover 47, as seen in FIG. 1, when aligned with a mark on knob 48 indicate the position of damper plate 43. When knob 48 has its marking aligned with the line for "OFF", plate 43 is in the closed position. When the marking on knob 48 is in alignment with the line indicated as "HI" the damper is at its maximum opened position. Another marking (not shown on FIG. 1) and a line on the front of cover 47 indicates predetermined position marked "EPF" (electrical power failure) to which knob 48 is manually turned when there is a power failure. The position of the line for "EPF" on cover 47 is such that, when the marking on the knob is manually aligned with it, damper plate 43 is open only sufficiently to maintain a fire and the temperature of the ductwork (mentioned later) in the building will not exceed the maximum safe temperature. When knob 48 has turned thermostat 45 from the "OFF" position to the "HI" position, the intake air will be introduced at the desired rate. When the temperature sensed by thermostat 45 exceeds that indicative of the desired temperature in the fire chamber, the dimension of the bimetallic element of thermostat 45 increases thereby permitting a partial closing of damper assembly 42 to the extent to reduce intake air until the temperature sensed by the thermostat 45 results in the return of damper plate 43 to its initial set position.

The major portion of the chamber provided by walls 19, 21, 23, 25 and 27 and front wall 17 is above grate 38 and grate support member 39. That major portion is the fire chamber into which fuel is loaded and burned.

The outer and inner walls of the rear of chamber 15 have aligned openings through which is mounted a flue pipe 50. On the portion of flue pipe 50 that extends rearwardly of wall 22 is mounted a flue collar 51 to secure an assembly (not shown) of stove pipes and elbows to connect pipe 50 to a chimney. The flue pipe 50 is mounted in an upper portion of walls 22 and 23.

A wall lining 52 is mounted on the inner face of wall 23. The upper center semi-circular portion of lining 52 is absent to permit the mounting of a flue deflector cup 53.

The outer wall 24 of the top of cabinet 15 has an opening 54 surrounding by an upwardly extending flange (not numbered) of wall 24. Ductwork (not shown except in connection with FIG. 11) is connected to cabinet 15 at this opening to pass heated air from cabinet 15 to rooms to be heated.

The bottom portion of outer wall 22 of the rear of cabinet 15 has an opening in alignment with the outlet of a blower assembly 55 mounted on wall 22. The motor 56 of blower assembly 55 is turned on whenever the temperature of heated air is sensed, e.g., as reaching 180° F., by a thermostat 57 mounted on outer wall 18 and extending into the front portion of the passageway between outer and inner walls 24 and 25 of the top of cabinet 15. This location of thermostat 57 on the side of cabinet 15 provides the advantage that thermostat 57 will not be affected by heat from the fire chamber when door 31 is open for a short time.

By the construction of this embodiment of the furnace of the invention, it is seen that none of the air introduced into the passageways provided by the double-walled construction of the top bottom, rear, and sides of cabinet 15 passes over thermostat 45. The only thermal energy imparted to thermostat 45 is radiant energy from outer wall 33 of door 31 that is heated when door 31 is heated by conduction and by radiant energy from the fire chamber during the burning of fuel. Some ambient air passes through the openings in the top wall of cover 47 but it is believed that most of the ambient air to damper 42 passes upwardly through the open bottom end of cover 47. The holes in the upper wall of cover 47 are present merely to insure that there is no dead space within the cover above damper plate 43, i.e., in the space where thermostat 45 is located. The flow of ambient air to be heated by the furnace and the separate flow of ambient air that passes into damper 42 and the chamber mentioned above is shown by arrows in FIGS. 4 and 5. The intake air for combustion passes into the spaces of the chamber below grate 38. To provide the secondary air, mentioned earlier, the periphery of grate support member 39 has spaced notched portions for flow of air into the fire chamber. Such construction is like that described later in connection with FIGS. 9 and 9A.

The embodiment of the furnace shown in FIGS. 6–10 has a cabinet, generally indicated at 65, that has a construction in many respects similar to cabinet 15. The cabinet 65 has spaced outer and inner walls 18 and 19 for one side, spaced outer and inner walls 20 and 21 for the other side, spaced outer and inner walls 22 and 23 for the rear and spaced outer and inner walls 24 and 25 for the top and spaced outer and inner walls 26 and 27 for the bottom of cabinet 65. The front of cabinet 65 has a different construction.

Figure 7:
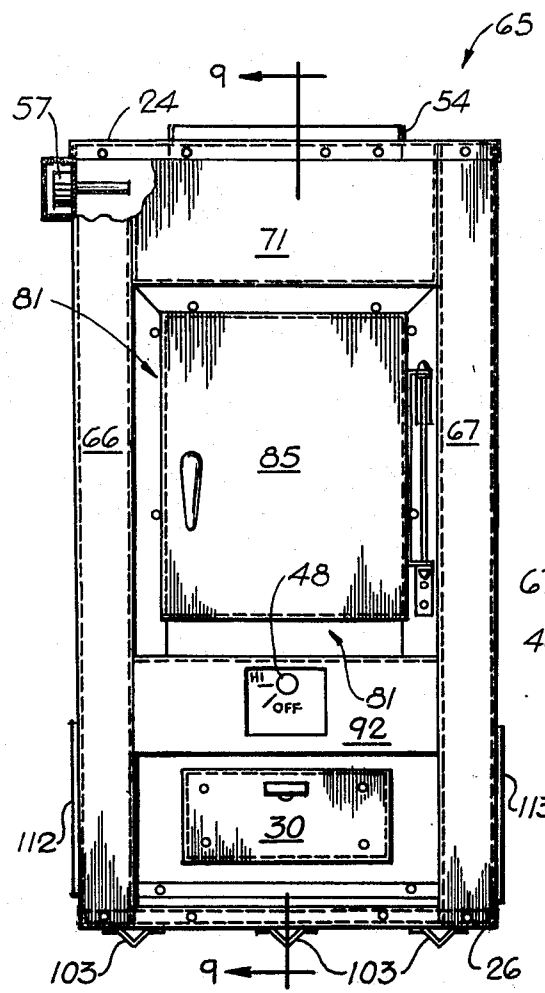
Figures 9, 9A, 10:
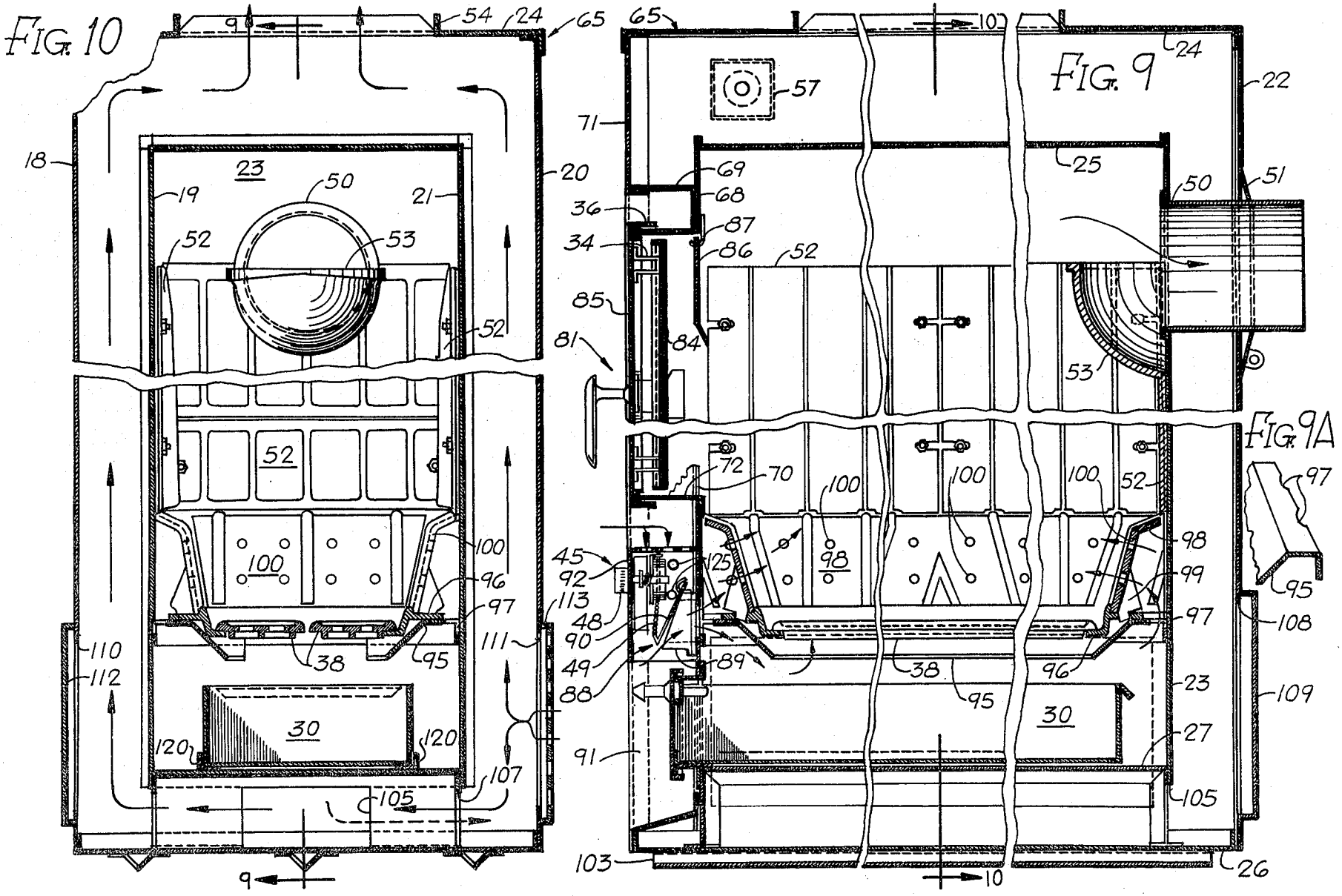
FIG. 9 is a vertical section taken along line 9—9 of FIG. 7 and a vertical section taken along line 9—9 of FIG. 10.
FIG. 9A is a fragmentary view of the grate support member showing some of the notches about the periphery of that member to permit flow of secondary air to the fire chamber from air below the grate.
FIG. 10 is a vertical section taken along line 10—10 of FIG. 6 and a vertical section taken along line 10—10 of FIG. 9.

The front of cabinet 65 includes two vertical, relatively narrow panels 66 and 67 (FIG. 7). One vertical margin of panel 66 has a rearwardly extending flange that is connected to outer side wall 18 (FIG. 9). The panel 67 has a similar rearward extension that is connected to outer side wall 20. The panels 66 and 67 extend from outer top wall 24 to outer bottom wall 26. The front of cabinet 65 has an inner wall 68 that is connected at its margins to inner side walls 19 and 21, inner top wall 25 and inner bottom wall 27. The inner front wall 68, inner side walls 19 and 21, inner rear wall 23, inner top wall 25 and inner bottom wall 27 provide the chamber mentioned above in the description of FIGS. 1–5.

The inner front wall 68 has upper and lower central rectangular openings and an intermediate circular opening. A top horizontal channel 69 and two vertical channels 70 are mounted on the front face of inner front wall 68 adjacent its margins at the upper opening. Each of these three channels has its pair of legs facing forwardly. An open channel-shaped panel 71 has its ends connected to panels 66 and 67 and has its top and bottom flanges under the front end and connected to outer top wall 24 and the upper leg of channel 69, respectively. By this construction the upper leg of channel 69 and a leg of each of channels 70 close the top and side openings at the top and sides of a large rectangular opening between panels 66, 67 and 71 and inner wall 68.

The bottom leg of channel 69 and the facing vertical flanges of channels 70 provide the top and two sides of a door frame. At the upper opening of wall 68 an angle iron 72 has its vertical component behind the bottom margin of inner front wall 68 to which it is connected. The horizontal component of angle iron 72 extends forwardly of wall 68 and provides the bottom part of the door frame.

A door generally indicated at 81 (FIGS. 7–9) is pivotally mounted by brackets 82 that are mounted on the front surface of the web of one of vertical channels 70. The door has a handle (not numbered) and latching means (not numbered) that engages a locking plate 83 mounted on the leg of the other vertical channel 70 that provides one of the members of the door frame. Like door 31, door 81 has an inner wall 84 and an outer wall 85 that are spaced from each other and secured together by spacers 34 and screws (not shown). The periphery of inner wall 84 is spaced slightly from the door frame. The periphery of outer wall 85 has a rearward extension that overlies the legs of channels 69 and 70 and overlies angle iron 72 with an high-temperature seal 36 located on outer door 85 to provide an airtight seal when door 81 is closed.

A smoke shield 86 is pivotally mounted by hooks 87 that is connected to inner front wall 68 so that shield 86 is at the upper portion of the upper opening of wall 68. This type of mounting permits shield 86 to pivot inwardly when adding fuel to the fire chamber of the furnace.

A damper, generally indicated at 88, includes a damper pipe 89 and a damper plate 90 that is mounted on pipe 89 as described for the first embodiment. The pipe 89 is mounted on inner front wall 68 so that it is in alignment with its intermediate circular opening.

Below angle iron 72 the vertical end of the part of panel 66, that is not connected to outer side wall 18, is connected to an inwardly directed vertical component 91 having a flange at the other end that is connected to inner front wall 68. This closes the space between panel 66 and inner front wall 68 where it is below the door frame for door 81. The opening between panel 67 and inner front wall 68 is closed in the same manner by a vertical component (not shown).

A bracket rotatably supporting thermostat 45 is mounted on wall 68. A cover 92 is mounted on wall 68 in front of the bracket and damper 88. The top wall of cover 92 has openings and the bottom is open. A knob 48 is secured on the end of the rod of thermostat 45 extending through a hole in the front of cover 92 that extends to and is aligned with walls 66 and 67. The front face of the vertical wall of cover 92 contains indicia as described above for cover 47 of the first embodiment of the furnace.

The grate 38 in this illustrative embodiment comprises two elongated grates as seen in FIG. 10. A rectangular support member 95 having a downwardly directed portion adjacent its margin has a rectangular opening at the bottom end of the downwardly turned portion. The support member 95 has a downwardly turned flange at its periphery and this flange is connected to inner walls 19, 21, 23 and 68 in order to support member 95 in a horizontal position. A rectangular grate support 96 has its margins resting on the marginal portion of member 95. The grate support member 96 has a downwardly offset portion adjacent its margin where there is a central rectangular opening of smaller dimension than the opening of member 95. The opening of grate support 96 is in alignment with the opening of member 95.

The grate 38 rests on the downwardly offset portion of grate support member 96. The margin of grate support member 96 at the location of its offset portion has an upwardly directed shoulder and the margin between that shoulder and the periphery of grate support member 96 has a number of spaced slots (not numbered). The support member 95 has in its downwardly turned peripheral flange and adjacent that flange a number of spaced notches 97 (FIGS. 9 and 9A). The support member 95 has its periphery in vertical alignment with damper pipe 89 and one of notches 97 is at this location. As a result, a part of the intake air passing through pipe 89 and the intermediate circular opening in inner wall 68 passes downwardly into the chamber below support member 95 and a part passes upwardly above grate support member 96 and thereby above grate 38. The intake air below support member 95 passes upwardly through the opening of member 95 and through grate 38 to provide primary air to the fire chamber. The air passing from pipe 89 upwardly of member 95 provides secondary air for the combustion, as described below.

A number of inclined firebox linings 98, that rest on grate support member 96, have, at their rear face, tabs 99 positioned in the slots of the margin of grate support member 96 mentioned above. The linings 98 extend upwardly in an inclined manner away from grate 38. The top portion of each lining 98 is angularly disposed relative to the bottom portion with the top end being generally vertical. The top end rests on one of the inner walls of the fire chamber or is spaced slightly from the inner wall.

Each of the firebox linings 98 has a set of holes 100, when the furnace is built to burn wood or coal that requires secondary air for combustion. In that case, as seen in FIGS. 9 and 10, the margin of grate support member 96 has notches (not numbered) for this passage of intake air into the space between the inner walls and firebox linings 100. These notches are aligned with notches 97 of support member 95. It is not necessary that firebox linings 98 rest against the inner walls in an airtight manner. The slight amount of air that would pass between them would merely be a small portion of secondary air for combustion in the fire chamber.

The linings 98 and grate 38 constitute the firebox of the furnace. On the sides of the fire chamber, above firebox linings 98, are mounted linings 52. They are on the inner surface of walls 19 and 21. The furnace has lining 52 and smoke deflector cup 53 as in the furnace of FIGS. 1–5. The furnace also contains flue pipe 50, that extends through rear walls 22 and 23, and flue collar 51.

The top of cabinet 65 has its outer wall 24 constructed as in the first embodiment for connection to ductwork. The thermostat 57 is mounted as described in the first embodiment.

The inner bottom wall 27 has an inverted box shape with an outwardly directed flange (not numbered) at its bottom. The flange rests on and is connected to outer bottom wall 26 supported on runners 103. The bottom margin of the inner walls of the cabinet, that define the fire chamber, are connected to the top portion of the sides of the box-like inner bottom wall 27. The back rear wall of box-like inner bottom wall 27 has a rectangular opening 105 for passage of air forwardly into the box-like inner bottom wall 26 (FIG. 9). As seen in FIG. 10, each of the vertical sides of box-like wall 27 has a similar opening. These are openings 106 and 107.

The outer rear wall 23 has a bottom central rectangular opening 108 that is closed by a cover 109. The opening 108 is used when the furnace of FIGS. 6–10 is provided cool air, to be heated, at its rear in some of the uses of the furnace. The outer side walls 18 and 20, at their bottom central portion, have openings 110 and 111, respectively (FIG. 10). The cover 112 closes opening 110. A cover (not shown) can cover opening 111. In FIG. 10 there is shown, instead of that cover on wall 20, a grille 113 to permit flow of air, to be heated, into the passageway between walls 20 and 21. The flow of this air is shown with solid arrows in FIG. 10. When both of openings 110 and 111 are covered and cover 109 is replaced by a grille or connected to a cold air return plenum chamber, the flow of air into the furnace is at the opening 105 and then as shown in part by a dotted arrow in FIG. 10.

A pair of spaced angle irons 120 are supported on inner bottom wall 27. The ash pan 30 is slidably mounted on angle irons 120. The front of pan 30 is constructed with a handle mounted on the front wall. The pan 30 extends forwardly through the lower rectangular opening of wall 68. Mounted on the front face of wall 68 at this lower opening are angle irons that provided a door frame for the opening. The front wall of pan 30, to function as a door, has a rearwardly extending flange about its periphery to surround the angle irons providing the door frame. A high-temperature seal is mounted on the inner surface of the front wall of pan 30 to be abutted by the door frame for an airtight seal when the front wall of pan 30 closes the lower opening of wall 68.

From the foregoing construction of the furnace of FIGS. 6–10, it is seen that there is provided a chamber for air to be heated. This chamber includes a vertical rear passageway between walls 22 and 23, a horizontal passageway between bottom walls 26 and 27, vertical side passageways between walls 18 and 19 and between walls 20 and 21, a vertical front passageway between panel 67 and wall 68 and a vertical front passageway between panel 67 and wall 68.

As seen in FIG. 9, the inwardly directed vertical component 91 has at the location of thermostat 45 a couple of holes 125 for the exit of heated air within the passageway between panel 66 and inner front wall 68. The holes 125 have illustratively a diameter of one-half inch. The heated air that exits from holes 125 provides the increased responsiveness of thermostat 45, described above, while it is primarily responsive to the radiant energy from inner wall 68 at this elevation which is above grate 38 and at the plane where firebox linings 98 are located. Except for this exiting air through holes 125, thermostat 45 is separated from the air to be heated. The passageways mentioned above where air is heated are interconnected and, except for the central part of cabinet 65 below panel 71, these interconnected passageways surround the inner chamber of cabinet 65 including the upper portion that is the fire chamber. Instead of holes 125 in member 91, similar holes can be in the inwardly directed vertical component that closes the space between panel 67 and inner wall 68 in the manner that member 91 does for panel 66 and wall 68.

The furnace of FIGS. 1–5 can be used alone or along with a forced air, gas-burning or oil-burning furnace, as the primary furnace. In the latter use, the furnace of the invention is placed alongside the primary furnace. The top outer wall of cabinet 15 at its opening is connected by a rectangular duct, or a round pipe with an adaptor, to the warm air plenum connecting the primary furnace to the ductwork that distributes warm air to rooms of the building. The blower 55 has its inlet connected to the cold air return plenum connected to the primary furnace.

Similarly, the furnace of FIGS. 6–10 can be used alone or with a primary furnace. There are various installations for the use with the primary furnace.

In one installation, cabinet 65 is connected by a duct at opening 111 to the warm air outlet of the primary furnace, when cabinet 65 has outer side wall 20 adjacent the primary furnace. In that installation the cover, like cover 112, or grille 113 is not at opening 111. The opening in top wall 24 of cabinet 65 communicates by a duct or pipe with the warm air plenum of the primary furnace installation. In an alternative installation the opening 111 is not connected by a duct to the primary furnace and a cover, like cover 112, is mounted at opening 111 while grille 113 replaces cover 112. Of course, when cabinet 65 is installed at the other side of the primary furnace, opening 110 is used with duct to connect cabinet 65 to the warm air outlet of the primary furnace. In that case a cover closes opening 111. If that connection is not used, grille 113 is mounted at opening 111.

In such latter installations, where cabinet 65 is on one side or the other side of the primary furnace, a baffle may be added below the elevation at which the duct connecting the top cabinet 65 at its outlet to the warm air plenum. When the baffle is added, warm air from the primary furnace flows through the passageways of cabinet 65. Other installations will be apparent from the foregoing description.

Figure 11:
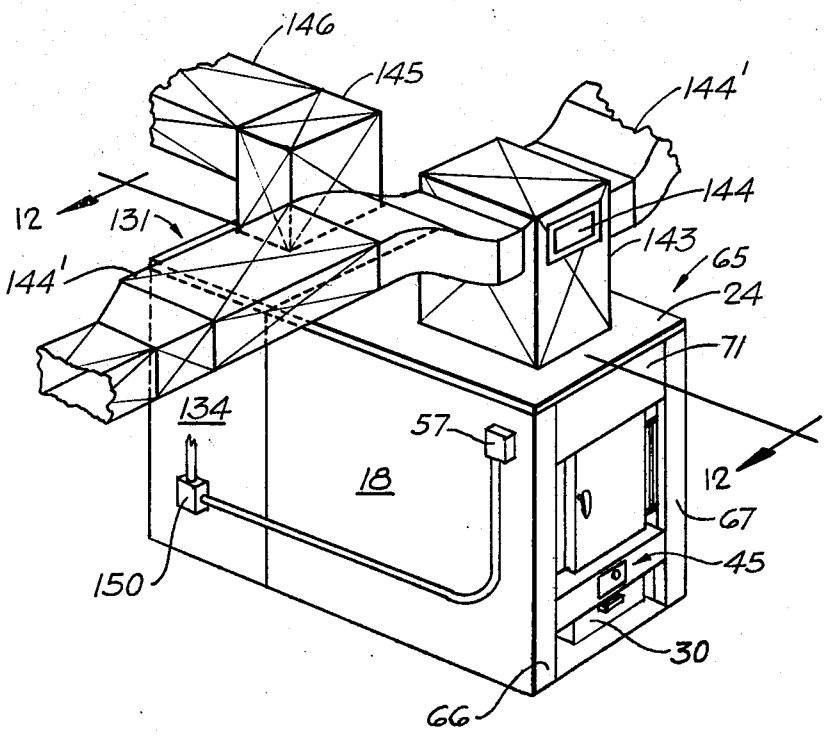
FIG. 11 is a perspective view of the furnace of FIGS. 6–10 in a combination of it with an abutting separate blower compartment, replacing the blower assembly of the furnace shown in FIGS. 6–10 for greater capacity to introduce air to be heated, and showing a fragmentary portion of ductwork layout used with the furnace to heat a number of rooms including the room in which the furnace if located.
Figure 12:
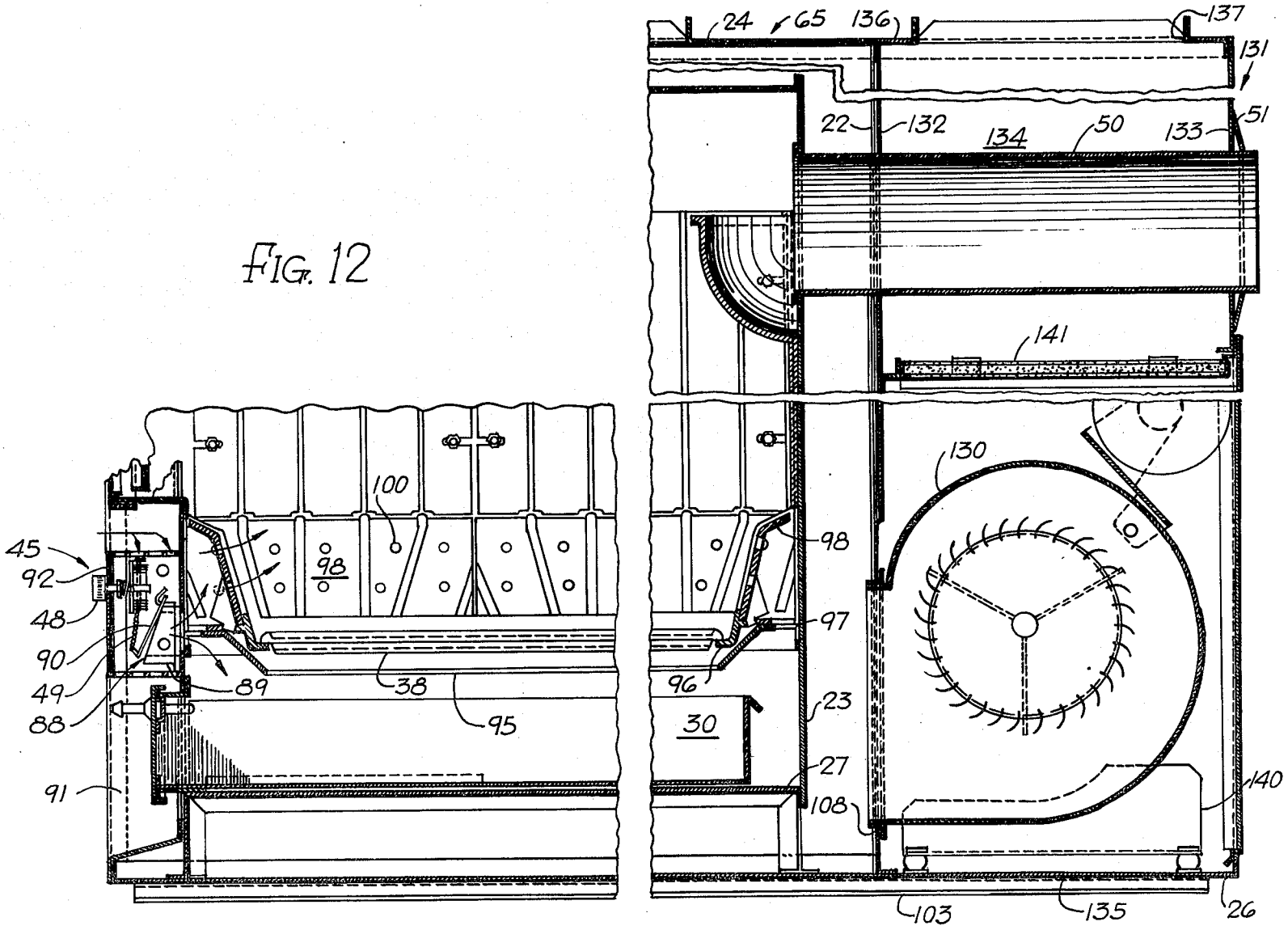
FIG. 12 is a fragmentary vertical section taken along line 12—12 of FIG. 11.

FIGS. 11–12 illustrate one use of the embodiment of the furnace of FIGS. 6–10. In that construction, openings 110 and 111 are not present in walls 19 and 20 or are, if present, closed by covers 112. In this installation for use of the furnace, cover 109 is removed and opening 108 in rear wall 22 has sufficient height to insert the forward open end of a blower housing 130 in a blower compartment, generally indicated at 131, that is placed behind cabinet 65. The compartment 131 has a front wall 132, a rear wall 133, a pair of side walls 134, a bottom wall 135 and a top wall 136. The runners 103 extend rearwardly of cabinet 65 and bottom wall 135 rests on runners 103. The top wall 136 is upwardly flanged at its opening 137. The flue pipe 50 is sufficiently long to extend through aligned openings in front and rear walls 132 and 133. The flue collar 51 is mounted on pipe 50 rearwardly of rear wall 133.

The blower housing 130 is supported by a member 140 that prevents its vibration. A blower (not numbered) includes a shaft (not numbered) to which it is connected by a drive connection. The motor is mounted on a support that is mounted on housing 130. Above housing 130 and the motor is mounted an air filter 141. As seen in FIG. 11, at the opening of top outer wall 24 of cabinet 65 is connected a warm air plenum 143 having a basement heat register 144. The plenum 143 is shown in FIG. 11 but not in FIG. 12. The sides of plenum 143 are connected to ductwork 144' of conventional construction to distribute warm air to the rooms of the building. At top opening 137 of top wall 136 of compartment 131 is connected to a cold air plenum 145 that is connected by ductwork 146 to the cold air return registers at various locations in the building.

A junction box 150 is connected to thermostat 57 and to the motor in compartment 131 that rotates the blower in housing 130.

The furnace having cabinet 65 and blower compartment 131 with the modification, as described above with respect to FIGS. 11–12, can be used with a primary furnace. For example, at its opening top outer wall 24 of cabinet 65 is connected to a warm air outlet duct with a manual duct damper that is closed when the furnace of the invention is not being used. This duct is connected at its other end to the warm air plenum connected to and installed for use with the primary furnace. The top wall 136 at its opening 137 is connected by a duct having a manual duct damper that is closed when the furnace of the invention is not being used. This duct is connected at its other end to the cold air return plenum connected to and installed for use with the primary furnace.

As stated earlier in connection with the embodiment of the furnace that is shown in FIGS. 1–5, there is an intermediate position ("EPF") to which knob 48 is turned when there is a power failure. This construction is present in the other embodiment of the furnace that is shown in FIGS. 6–12. It is a very important part of the construction to reduce the amount of intake air so that the temperature of the ductwork does not exceed the maximum safe temperature.

Various constructions of means responsive to power failure to automatically lower the damper plate to the predetermined "EPF" position for the maintenance of decreased combustion are contemplated. For example, the rod on which thermostat 45 is mounted can have a couple of radial extensions ("EPF" and "HI") that are axially spaced from each other. This modification further includes a pair of latching means. One is in alignment with the "EPF" radial extension. The other is in alignment with the "HI" radial extension. Each is constructed with a plunger to manually raise the latch of the latching means out of the path of travel of the corresponding radial extension of the rod for lowering the damper plate. To rotate the rod so that the damper plate is raised from the closed position to the open position indicated by the knob being at its "HI" position the radial extensions in sequence will lift the associated latch that will then return to prevent return movement of the latch. When knob 48 is fully turned to "HI", the "HI" latch arm maintains it in that position. When the "HI" latch arm is raised by pressing the plunger, the knob will turn until it is stopped by the "EPF" latch. It can be released from the latter position by manually pressing the plunger that raises the "EPF" latching arm that holds it at that position. In this modification for automatic lowering of the damper plate to the position required for a safe maximum temperature of ductwork, the "HI" latch arm that prevents turning of the rod from the "HI" position can be a solenoid-operated latch in which the solenoid when energized by electrical power keeps the latch arm in a latching position, except for plunger-operated movement, until power is lost. Then the "HI" latch arm moves out of the way. The rod turns until its "EPF" radial extension abuts the "EPF" latch arm.

The foregoing description has been presented solely for the purpose of illustration and not by way of limitation of the invention because the latter is limited only by the claims that follow.

We claim:

1. A furnace, useful to burn wood or coal, which comprises:

a cabinet having a double-walled construction for its sides, top, bottom and rear to provide passageways between the pairs of spaced inner and outer walls for air to be heated by said furnace and having a front wall with at least one opening, said cabinet at its upper portion having aligned openings in one pair of said spaced inner and outer walls, and having an air inlet in one of said outer walls and a heated air outlet in one of said outer walls;

a grate mounted in a lower portion of the cabinet to provide a fire chamber defined by said grate, said inner walls of said sides, top, bottom and rear of said cabinet and said front wall of said cabinet;

door means mounted on said front wall of said cabinet, said door means at said front wall of said cabinet being constructed to provide an airtight closing of said front of said cabinet when said door means is in the closed position;

a damper including a damper pipe and a damper plate, said damper pipe being mounted on one of said door means and said front wall of said cabinet and said damper plate being pivotally mounted at its top on the front end of said pipe;

temperature sensing means;

means supporting said temperature sensing means in a manner to permit relative movement between said support means and said temperature sensing means, said support means being mounted on one of said door means and said front wall of said cabinet to support said temperature sensing means above said damper plate; and means connecting said temperature sensing means and said bottom portion of said damper plate to raise said damper plate by movement of said temperature sensing means, said furnace including means whereby said temperature sensing means is separated from said fire chamber by said front wall of said cabinet and said door means that provides radiant energy toward said temperature sensing means, and said furnace including means to separate, at least almost entirely, said temperature sensing means from any flow of air that has moved through any of said passageways of said cabinet, thus providing means whereby the main thermal energy provided to said temperature sensing means is radiant energy from either said front wall or said door means, as the case may be, that separates it from said fire chamber.

2. The furnace of claim 1 wherein:

said front wall of said cabinet has one large central opening extending from a horizontal plane adjacent said inner top wall of said cabinet to a horizontal plane passing below said grate and at its sides extending to overlie the vertical planes passing through said inner walls of said sides of said cabinet;

said cabinet is provided with a door frame mounted on said front wall at said central opening and having an extension forwardly of said front wall;

said door means comprises one door having an inner wall and an outer wall with the outer wall constructed at its periphery to overlie said forward extension of said door frame and provided with a high-temperature seal to abut said forward extension of said door frame for an airtight seal when said door is closed, said inner wall of said door having smaller dimensions than said outer wall of said door to be positioned within said door frame and having a bottom above the horizontal plane passing through said grate and said outer wall of said door, below said inner wall of said door, having an opening at its bottom portion at which is mounted said damper pipe;

said temperature sensing means being mounted on said outer wall of said door;

said mounting of said grate in said cabinet being supported by a grate support that is upwardly turned at its front margin where it has a hole in alignment with said damper pipe and said grate support having a number of notches at its periphery to provide flow of some intake air from said pipe directly into the fire chamber and flow of the balance of the intake air into the space in said cabinet below said grate and then through said grate and said notches of said grate support into said fire chamber.

3. The furnace of claim 2 wherein:

said temperature sensing means includes a bimetallic thermostat and a rod rotatably mounting said thermostat on said outer wall of said door and extending forwardly to provide raising of said damper plate when said rod is turned; and said means connecting said temperature sensing means and said damper plate is a chain.

4. The furnace of claim 1 wherein:

said outer top and side walls of said cabinet have extensions forwardly of said front wall of said cabinet;

said front wall of said cabinet has vertical spaced upper intermediate and lower openings; and said door means includes an upper door mounted on said front wall at said upper opening and a lower door mounted on said front wall at said lower opening and constituting the front wall of said ash pan, said cabinet further including:

an upper door frame mounted on said front wall of said cabinet in alignment with said upper opening of said front wall; and a lower door frame mounted on said front wall of said cabinet in alignment with said lower opening of said front wall, an upper panel spaced from and forwardly of the top margin of said front wall of said cabinet and connected to said forward extension of said outer top wall and of said top of said door frame at its forward portion;

first and second vertical panels spaced forwardly of the vertical margins of said front wall of said cabinet and connected to said extensions of said outer walls of said top and sides of said cabinet, said horizontal panel being at the vertical plane of said top panel and connected thereto, with said vertical panels being connected to the forward portion of the sides and the bottom of said upper door frame; and third and fourth vertical panels extending from the bottom of said first door frame to the bottom of said cabinet and connecting the margin of said first and second panels to said front panel of said cabinet to complete the vertical passageways interconnecting with said top and sides of said cabinet, and further wherein;

said damper of said temperature sensing means being mounted on front said wall with damper pipe being in alignment with said intermediate opening; and said grate being mounted by support means having a notch at its periphery in alignment with said intermediate opening and having additional notches so that there is flow of some intake air from said pipe directly into the fire chamber and flow of the balance of the intake air into the space in said cabinet below said grate and then through said grate and said additional notches of said grate support means into said fire chamber.

5. The furnace of claim 4 wherein:

said temperature sensing means includes a bimetallic thermostat and a rod rotatably mounting said thermostat on said outer wall of said door and extending forwardly to provide raising of said damper plate when said rod is turned; and said means connecting said temperature sensing means and said damper plate is a chain.

6. The furnace of claim 4 or claim 5 wherein one of said third and fourth vertical panels has small openings at the elevation of said temperature sensing means to exit a small amount of air being heated toward said temperature sensing means.

* * * * *